US009977392B2

(12) United States Patent
Suwa

(10) Patent No.: US 9,977,392 B2
(45) Date of Patent: May 22, 2018

(54) IMAGE FORMING APPARATUS

(71) Applicant: Konica Minolta, Inc., Tokyo (JP)

(72) Inventor: Yoshiyuki Suwa, Tachikawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/376,864

(22) Filed: Dec. 13, 2016

(65) Prior Publication Data

US 2017/0227913 A1 Aug. 10, 2017

(30) Foreign Application Priority Data

Feb. 10, 2016 (JP) ..... 2016-024055

(51) Int. Cl.
*G03G 15/00* (2006.01)
*G03G 21/16* (2006.01)
*G03G 21/18* (2006.01)

(52) U.S. Cl.
CPC ..... *G03G 15/75* (2013.01); *G03G 15/751* (2013.01); *G03G 21/1647* (2013.01); *G03G 21/181* (2013.01)

(58) Field of Classification Search
CPC .. G03G 15/75; G03G 15/751; G03G 15/0894; G03G 21/1647; G03G 21/181; G03G 2215/00987
See application file for complete search history.

(56) References Cited

U.S. PATENT DOCUMENTS 1,008,507 A * 11/1911 Wheat ..... B41F 27/105 101/375
4,823,160 A * 4/1989 Ikuta ..... G03G 15/751 399/117
8,915,185 B2 * 12/2014 Pantchev ..... B41F 13/24 101/383
2014/0294444 A1 * 10/2014 Kawai ..... G03G 15/757 399/167
2017/0168450 A1 * 6/2017 Omura ..... G03G 21/1842

FOREIGN PATENT DOCUMENTS

JP H05-289588 A 11/1993

OTHER PUBLICATIONS

Machine Translation of JP H05-289588. Nov. 5, 1993.*

* cited by examiner

*Primary Examiner* — Carla Therrien
(74) *Attorney, Agent, or Firm* — Lucas & Mercanti, LLP

(57) ABSTRACT

An image forming apparatus includes: a photosensitive drum; a process frame from which the photosensitive drum is detachable; an apparatus body from which the process frame is removable; a drum shaft including one end constituting a free end, and another end supported by the apparatus body, and transmitting rotational driving force to the photosensitive drum; and a fixing member configured to stop movement of the photosensitive drum, wherein the one end of the drum shaft is configured to penetrate through and protrude from the photosensitive drum, the photosensitive drum includes a first annular protruding portion, the process frame includes a bearing part, the fixing member includes a second annular protruding portion, the one end of the drum shaft is pivotally supported by the fixing member, and the first annular protruding portion of the photosensitive drum is pivotally supported by the second annular protruding portion of the fixing member.

8 Claims, 7 Drawing Sheets

| | | EXAMPLE 1 (FIG. 3) | EXAMPLE 2 (FIG. 4) | COMPARATIVE EXAMPLE 1 (FIG. 8) | COMPARATIVE EXAMPLE 2 (FIG. 9) | COMPARATIVE EXAMPLE 3 (FIG. 10) |
|---|---|---|---|---|---|---|
| DRUM SWING [μm] | N NUMBER | 16 | 16 | 20 | 24 | 29 |
| | AVERAGE | 38.1 | 32.4 | 65.7 | 38.9 | 36.7 |
| | σ | 14.6 | 10.2 | 22.8 | 16.2 | 15.8 |
| | MAXIMUM | 60 | 49 | 104 | 68 | 65 |
| | EVALUATION | A | A | F | B | B |
| DRUM HOLDING FORCE EVALUATION | | A | A | A | B | A |

IMAGE FORMING APPARATUS

The entire disclosure of Japanese Patent Application No. 2016-024055 filed on Feb. 10, 2016 including description, claims, drawings, and abstract are incorporated herein by reference in its entirety.

BACKGROUND OF THE INVENTION

Field of the Invention

The present invention relates to an image forming apparatus.

Description of the Related Art

In a conventional image forming apparatus, since a photosensitive drum is directly supported by a bearing part, when the photosensitive drum is replaced, it is necessary to be disassembled, and its maintenance has not been easy (for example, see JP 05-289588 A).

Therefore, a technology has been devised for ensuring detachment easiness of the photosensitive drum by using: a process frame from which the photosensitive drum is detachable; an apparatus body from which the process frame is removable; a drum shaft including one end constituting a free end and the other end supported by the apparatus body and transmitting rotational driving force to the photosensitive drum; and a fixing member for stopping movement of the photosensitive drum in an axial direction of the drum shaft.

Here, to ensure detachment easiness of the photosensitive drum, it is necessary to provide a fitting gap between the photosensitive drum and the drum shaft, between the drum shaft and the fixing member, and the like. In the process frame, in addition to the photosensitive drum, an imaging unit is also arranged including a developing device, a charging unit, a cleaning device, and the like. The imaging unit is longer than the photosensitive drum in an insertion/removal direction of the process frame to ensure the maximum image area.

As a result, the process frame and the fixing member also become long, and influence is increased of part accuracy of a contact portion of the photosensitive drum and the fixing member (for example, squareness with respect to the drum shaft), and there is a problem that deviation to one side of the fitting gap (a phenomenon in which the fitting gap comes to one side in a radial direction from the contact portion as a point of origin) is caused.

Further, it is necessary to increase contact force to the fixing member and the photosensitive drum to inhibit the photosensitive drum from idly rotating on the drum shaft, and there is a problem that bending is caused of the drum shaft from the contact portion as a point of origin.

SUMMARY OF THE INVENTION

The present invention has been made to solve the problems associated with the above conventional technology, and it is an object to provide an image forming apparatus capable of inhibiting runout of the photosensitive drum while ensuring detachment easiness of the photosensitive drum.

The above object of the present invention is achieved by the following solutions.

(1) To achieve the above mentioned object, according to an aspect, an image forming apparatus reflecting one aspect of the present invention comprises:

a photosensitive drum;

a process frame from which the photosensitive drum is detachable;

an apparatus body from which the process frame is removable;

a drum shaft including one end constituting a free end, and another end supported by the apparatus body, and transmitting rotational driving force to the photosensitive drum; and a fixing member configured to stop movement of the photosensitive drum in an axial direction of the drum shaft, wherein the one end of the drum shaft is configured to penetrate through and protrude from the photosensitive drum, the photosensitive drum includes a first annular protruding portion configured to surround an outer circumference of the one end of the drum shaft, the process frame includes a bearing part configured to support the fixing member, the fixing member includes a second annular protruding portion configured to surround an outer circumference of the first annular protruding portion of the photosensitive drum, the one end of the drum shaft is pivotally supported by the fixing member supported by the bearing part, and the first annular protruding portion of the photosensitive drum is pivotally supported by the second annular protruding portion of the fixing member supported by the bearing part.

(2) The image forming apparatus of Item. 1, wherein the bearing part is preferably arranged to face a region in which the one end of the drum shaft, the first annular protruding portion of the photosensitive drum, and the second annular protruding portion of the fixing member overlap with each other.

(3) The image forming apparatus of Item. 1 or 2, wherein an end portion of the first annular protruding portion of the photosensitive drum in a removal direction in which the photosensitive drum is removed from the drum shaft, is preferably in contact with the fixing member at a position of the removal direction side from an end portion of the bearing part in the removal direction.

(4) The image forming apparatus of any one of Items. 1 to 3, wherein the apparatus body preferably includes a bearing part configured to support the other end of the drum shaft.

(5) The image forming apparatus of any one of Items. 1 to 4, preferably further comprising a fastening member configured to fasten the photosensitive drum and the drum shaft together through the fixing member.

(6) The image forming apparatus of Item. 5, wherein the fixing member preferably includes a through-hole communicating with the second annular protruding portion, the one end of the drum shaft preferably includes a recess portion in which a screw thread is formed, the fastening member preferably includes a protruding portion penetrating the through-hole of the fixing member and being inserted to the recess portion of the drum shaft, and the protruding portion of the fastening member preferably includes a screw thread to be screwed into the screw thread of the recess portion of the drum shaft.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 2A illustrates mounting of the photosensitive drum to the process frame, FIG. 2B illustrates a guide protruding from an apparatus body, FIG. 2C illustrates insertion of the process frame to the apparatus body, and FIG. 2D illustrates fixing of the photosensitive drum mounted on the process frame;

DESCRIPTION OF THE PREFERRED EMBODIMENTS

Hereinafter, an embodiment of the present invention will be described with reference to the drawings. However, the scope of the invention is not limited to the illustrated examples. Incidentally, dimensional ratios of the drawings are exaggerated for convenience of description, and may be different from actual ratios.

Figure 1:
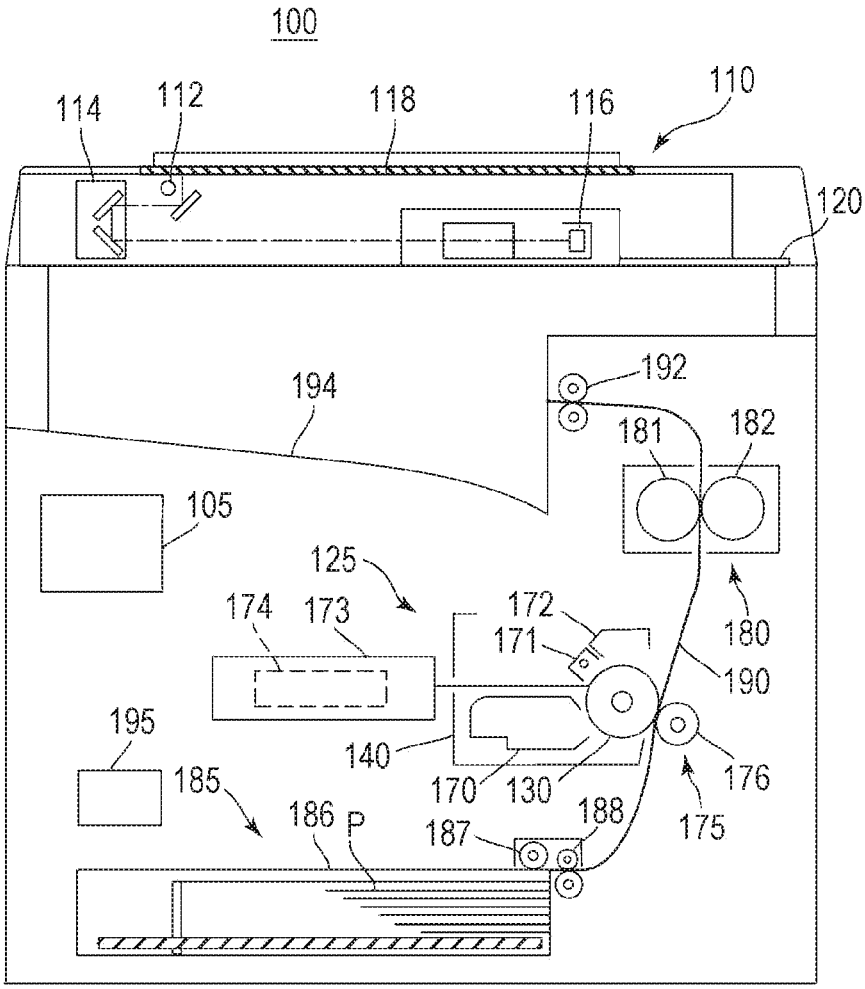
FIG. 1 is a sectional view for explaining an image forming apparatus according to an embodiment of the present invention.

FIG. 1 is a sectional view for explaining an image forming apparatus according to an embodiment of the present invention.

An image forming apparatus 100 illustrated in FIG. 1 is a monochrome copier, and includes a control unit 105, an image reading unit 110, an operation display unit 120, an image forming unit 125, a transfer unit 175, a fixing unit 180, a sheet feeding unit 185, a sheet conveying unit 190, and a communication interface 195.

The control unit 105 includes: a control circuit configured from a microprocessor for executing control of the above units and various types of calculation processing according to a program, and the like; and a storage unit to be used for storing various programs and data, and each function of the image forming apparatus 100 is exerted by causing the control unit 105 to execute a program corresponding to the function.

The image reading unit 110 is used for generating image data of a document to be copied, and includes a light source 112, an optical system 114, and an imaging element 116. The light source 112 emits light to the document placed on a reading surface 118, and its reflection light is focused via the optical system 114 on the imaging element 116 moved to a reading position. The imaging element 116 is configured from, for example, a linear image sensor, and generates (performs photoelectric conversion) an electrical signal depending on reflection light intensity. The electrical signal generated is input to the image forming unit 125 after image processing. The image processing includes A/D conversion, shading correction, filter processing, and image compression processing. Incidentally, the image reading unit 110 can be provided with an auto document feeder (ADF), as needed.

The operation display unit 120 is configured from, for example, a liquid crystal display (LCD) and a keyboard. The LCD is an output unit to be used for presenting a device configuration, a progress state of a print job, an occurrence state of an error, and a setting currently changeable, to a user. The keyboard is used when the user performs character input, various settings, and various instructions (inputs) such as a start instruction, and includes a plurality of keys configured from, for example, a select key for specifying a size of a sheet P, a numeric key for setting the number of copies and the like, a start key for instructing to start operation, and a stop key for instructing to stop operation.

The image forming unit 125 is used for forming an image on the sheet P that is a recording medium by using an electrophotographic process, and includes a process frame 140 and an optical writing unit 173. Developing powder for the electrophotographic process is configured from, for example, non-magnetic toner and magnetic carriers.

The process frame 140 includes a photosensitive drum 130 and an imaging unit. The imaging unit includes a developing device 170, a charging unit 171, and a cleaning device 172.

The photosensitive drum 130 is an image carrier including a hollow cylindrical main body part (base) and a photosensitive layer, and is configured to rotate at a predetermined speed. The main body part (base) is configured from, for example, metal such as aluminum. The photosensitive layer is configured from, for example, resin such as polycarbonate containing an organic photo conductor (OPC).

The developing device 170 is a unit for developing an electrostatic latent image formed on the photosensitive drum 130 and visualizing the image with toner.

The charging unit 171 includes a corona discharge electrode arranged around the photosensitive drum 130, and charges a surface of the photosensitive drum 130 with ions to be generated.

The cleaning device 172 is used for maintaining an excellent surface state of the photosensitive drum 130 by scraping (removing) toner remaining on the surface of the photosensitive drum 130 after a toner image is transferred to the sheet P.

The optical writing unit 173 incorporates an optical scanner 174, and, based on input image data from the image reading unit 110, exposes the photosensitive drum 130 charged to decrease an electrical potential of a portion exposed, and forms a charge pattern (electrostatic latent image) corresponding to the image data. Incidentally, the optical writing unit 173 can be arranged in the process frame 140, as needed.

The transfer unit 175 includes a transfer roller 176. The transfer roller 176 is pressed against the photosensitive drum 130 to form a transfer nip, and is driven to rotate in accordance with rotation of the photosensitive drum 130. While the sheet P passes through the transfer nip, the toner image carried on the photosensitive drum 130 is transferred to the sheet P by a function of a transfer electric field generated by a transfer voltage applied to the transfer roller 176.

The fixing unit 180 includes a fixing roller 181 and a pressing roller 182. The fixing roller 181 is positioned at a side in which a toner image to be fixed on the sheet P is arranged, and includes a heater for heating the sheet P. The pressing roller 182 is positioned at an opposite side to the fixing roller 181 through the sheet P, and is elastically urged to press the sheet P. While the toner image transferred onto the sheet P passes between the fixing roller 181 and the pressing roller 182, the sheet P is pressed and heated, and the toner image is melted and fixed. The fixing roller 181 can be configured by a plurality of rollers including a roller having a heater, and a roller not having a heater.

The sheet feeding unit 185 is used for accommodating the sheet P on which the image is to be formed, and includes, for example, a sheet feeding cassette 186, a feeding roller 187, and a handling roller 188. The sheet feeding cassette 186 is configured to be detachable from the sheet feeding unit 185. The feeding roller 187 and the handling roller 188 are configured to feed the sheet out one by one from the sheet feeding cassette 186 to the sheet conveying unit 190.

The sheet conveying unit 190 is used for conveying the sheet P accommodated in the sheet feeding unit 185 via the image forming unit 125, the transfer unit 175, and the fixing unit 180. The sheet conveying unit 190 can be provided with a sheet reversing unit for ejecting the sheet P while reversing the front and back of the sheet P, or forming images on both surfaces of the sheet P, as needed. Incidentally, a sheet ejection roller 192 and a sheet ejection tray 194 are used for ejecting the sheet P to the outside of the apparatus.

The communication interface 195 is an extension device configured from a so-called LAN board, and is used for adding to the image forming apparatus 100 a communication function for executing transmission/reception of data via a network. The data to be received is, for example, a print job.

The network includes various networks such as: a local area network (LAN) for connecting computers and network devices to each other with the standard such as Ethernet (registered trademark), token ring, or fiber-distributed data interface (FDDI); a wide area network (WAN) for connecting the LANs to each other with a dedicated line; the Internet; and a combination thereof. The network protocol is, for example, transmission control protocol/internet protocol (TCP/IP).

Next, a fixing structure of the process frame and the photosensitive drum is described in detail.

Figure 2A:
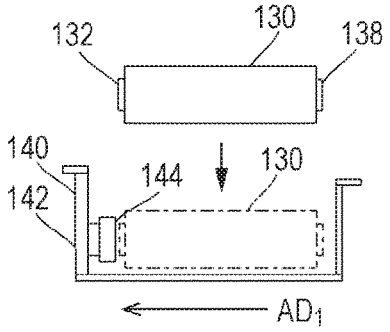
FIGS. 2A to 2D are schematic diagrams for explaining a process frame and a photosensitive drum illustrated in FIG. 1, where
Figure 2B:
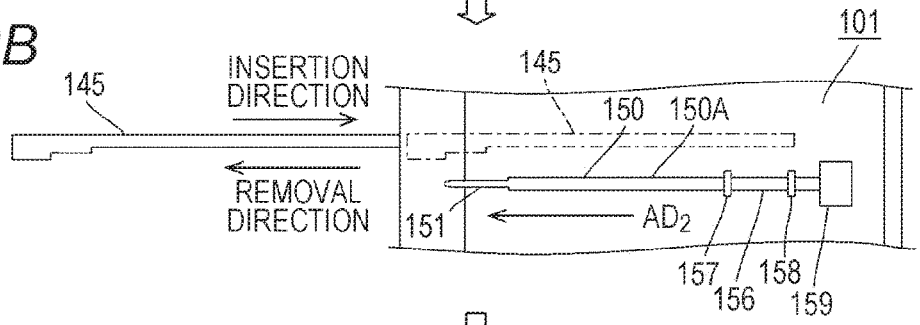
Figure 2C:
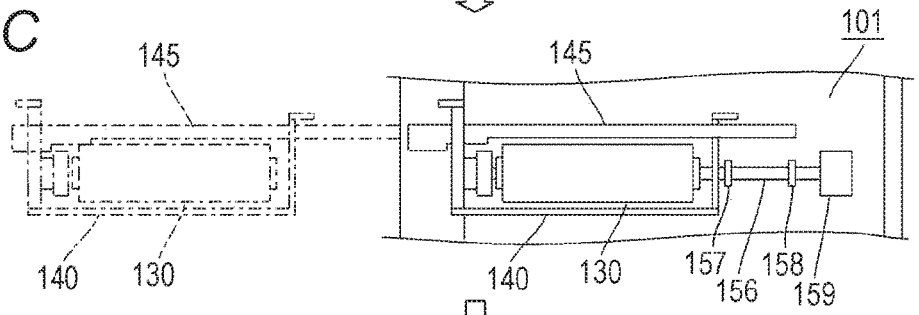
Figure 2D:
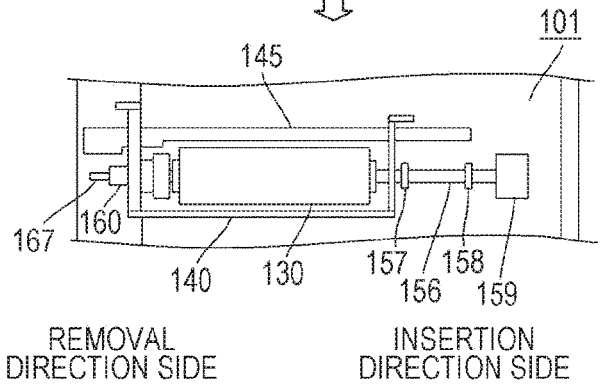

FIGS. 2A to 2D are schematic diagrams for explaining the process frame and the photosensitive drum illustrated in FIG. 1, and FIG. 2A illustrates mounting of the photosensitive drum to the process frame, FIG. 2B illustrates a guide protruding from an apparatus body, FIG. 2C illustrates insertion of the process frame to the apparatus body, and FIG. 2D illustrates fixing of the photosensitive drum mounted on the process frame. In the figures, the developing device 170, the charging unit 171, and the cleaning device 172 are omitted.

The process frame 140 is configured so that the photosensitive drum 130 is detachable from the process frame 140, and includes a frame 142 having a bearing part 144 (FIG. 2A). The bearing part 144 is provided to support a fixing member described later.

The photosensitive drum 130 includes flange portions 132, 138 respectively positioned at both ends of the hollow cylindrical main body part (base). Each of the flange portions 132, 138 includes an opening, and is configured so that one end 151 of a removal direction side of a drum shaft 150 described later is able to extend in an axial direction $AD_1$ of the photosensitive drum 130, and to penetrate the inside of the photosensitive drum 130.

An apparatus body 101 is configured so that the process frame 140 is removable from the apparatus body 101, and includes a guide 145, the drum shaft 150, bearing parts 157, 158, and a drive device 159.

The guide 145 is provided to facilitate insertion of the process frame 140 to the apparatus body 101, and is configured to be able to protrude from the apparatus body 101 (FIG. 2B).

The drum shaft 150 is provided to transmit rotational driving force to the photosensitive drum 130, and includes the one end 151 positioned at the removal direction side, and another end 156 positioned at an insertion direction side. Incidentally, an axial direction $AD_2$ of the drum shaft 150 coincides with the axial direction $AD_1$ of the photosensitive drum 130 in a state in which the process frame 140 is inserted to the apparatus body 101.

The other end 156 of the insertion direction side is supported by the bearing parts 157, 158, and is coupled to the drive device 159. The drive device 159 is configured to rotationally drive the other end 156. The support structure of the other end 156 of the drum shaft 150 is not limited to the form using the bearing parts 157, 158.

The one end 151 of the removal direction side constitutes a free end, and is configured to protrude from the flange portion 132 through the inside of the photosensitive drum 130 in the state in which the process frame 140 is inserted to the apparatus body 101 (FIG. 2C).

Incidentally, as described later, it is configured so that the one end 151 of the removal direction side is in contact with a fixing member 160 for stopping movement of the photosensitive drum 130 in the axial direction $AD_2$ of the drum shaft 150, and the photosensitive drum 130 and the drum shaft 150 are fastened by a fastening member 167 through the fixing member 160 (FIG. 2D). Therefore, the other end 156 of the drum shaft 150 is rotationally driven by the drive device 159, whereby the photosensitive drum 130 fastened to the drum shaft 150 is rotated.

Next, a fixing structure of the photosensitive drum using the fixing member and the fastening member is described in detail.

Figure 3:
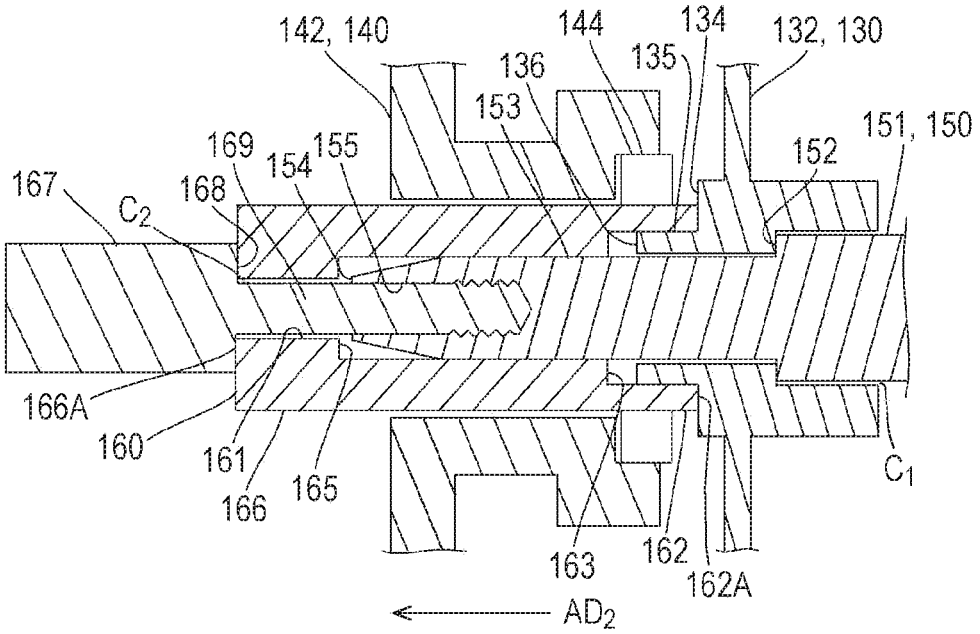
FIG. 3 is a sectional view for explaining a fixing structure of a removal direction side of the photosensitive drum.

FIG. 3 is a sectional view for explaining the fixing structure of the removal direction side of the photosensitive drum.

As illustrated in FIGS. 2A to 2D and FIG. 3, the drum shaft 150 includes a drum shaft body 150A, a step portion 152, and a reduced diameter portion 153. The reduced diameter portion 153 is a portion having a smaller outer circumferential diameter than that of the drum shaft body 150A. The reduced diameter portion 153 includes an end surface 154 in which a recess portion 155 is formed. The recess portion 155 includes an inner circumferential surface in which a screw thread is formed. The step portion 152 is a portion in which the outer circumferential diameter decreases when viewed from the drum shaft body 150A toward the removal direction side, and is an annular surface. Further, the step portion 152 is configured to be in contact with the inner side surface of the flange portion 132 of the photosensitive drum 130. Incidentally, a predetermined clearance $C_1$ is set between the outer circumference of the drum shaft body 150A and the flange portion 132 of the photosensitive drum 130.

The flange portion 132 of the photosensitive drum 130 includes a step portion 134 and an annular protruding portion (first annular protruding portion) 135. The step portion 134 is a portion in which an outer circumferential diameter of the flange portion 132 decreases when viewed from the drum shaft body 150A toward the removal direction side, and is an annular surface. The annular protruding portion 135 is configured to surround a part of the outer circumference of the reduced diameter portion 153, in a place apart from the step portion 152 by a predetermined distance in the axial direction $AD_2$ of the drum shaft 150 (a portion protruding from the photosensitive drum 130).

The fixing member 160 is a substantially cylindrical member, and includes an annular protruding portion (second annular protruding portion) 162 positioned proximal to the photosensitive drum 130 from the step portion 165 in the axial direction $AD_2$ of the drum shaft 150, and a base portion 166 positioned at a distal side from the photosensitive drum 130.

The annular protruding portion 162 is configured to surround the outer circumference of the annular protruding portion 135 of the photosensitive drum 130, and an end surface 162A of the annular protruding portion 162 is in contact with the step portion 134 of the flange portion 132 of the photosensitive drum 130. Therefore, the fixing member 160 is capable of stopping movement of the photosensitive drum 130 in the axial direction $AD_2$ of the drum shaft 150.

The base portion 166 includes a through-hole 161 communicating with the annular protruding portion 162, and an end surface 166A being in contact with the fastening member 167.

Here, the fixing member 160 has an inner diameter size changing in the middle thereof, and includes step portions 163, 165. The step portion 163 is configured to have an inner diameter size smaller than that of the end surface 162A of the annular protruding portion 162 when viewed from the drum shaft body 150A toward the removal direction side, and not to be in contact with an end surface 136 of the annular protruding portion 135 in the flange portion 132 of the photosensitive drum 130. The step portion 165 is configured to define a boundary between the annular protruding portion 162 and the base portion 166, and to have an inner diameter size smaller than that of the step portion 163 and larger than that of the through-hole 161, and not to be in contact with the end surface 154 of the reduced diameter portion 153 of the drum shaft 150.

The bearing part 144 of the process frame 140 is arranged to face (surround) the outer circumference of the annular protruding portion 162 of the fixing member 160.

The fastening member 167 is a substantially columnar member, and includes a step portion 168 and a protruding portion 169.

The step portion 168 is configured to be a portion in which an outer circumferential diameter increases when viewed from the protruding portion 169 toward the removal direction side, and to be an annular surface, and to be in contact with the end surface 166A of the base portion 166 of the fixing member 160. The protruding portion 169 is configured to include a screw thread in the outer circumference thereof, and to be able to be inserted to the recess portion 155 of the end surface 154 in the reduced diameter portion 153 of the drum shaft 150 through the through-hole 161 of the base portion 166 of the fixing member 160. The screw thread of the protruding portion 169 is set to be screwed into the screw thread of the recess portion 155 of the end surface 154 in the reduced diameter portion 153 of the drum shaft 150. Incidentally, a predetermined clearance $C_2$ is set between the outer circumference of the protruding portion 169 and the through-hole 161 of the base portion 166 of the fixing member 160.

Therefore, when the protruding portion 169 of the fastening member 167 is inserted to the recess portion 155 of the one end 151 of the drum shaft 150, and the screw threads are screwed together, in a state in which the end surface 162A of the annular protruding portion 162 of the fixing member 160 is in contact with the step portion 134 of the flange portion 132 of the photosensitive drum 130, the step portion 168 of the fastening member 167 is in contact with the end surface 166A of the base portion 166 of the fixing member 160, and the step portion 152 of the one end 151 of the drum shaft 150 is in contact with the inner side surface of the flange portion 132 of the photosensitive drum 130.

Therefore, the fixing member 160 and the photosensitive drum 130 are clamped by the fastening member 167 and the drum shaft 150. That is, the fastening member 167 is able to fasten the photosensitive drum 130 and the drum shaft 150 together through the fixing member 160.

At this time, since the fixing member 160 is supported by the bearing part 144 of the process frame 140, the photosensitive drum 130 fastened to the drum shaft 150 is rotated by the drive device 159 by rotationally driving the other end 156 of the drum shaft 150.

Incidentally, the one end 151 of the drum shaft 150 is pivotally supported by the fixing member 160 supported by the bearing part 144 of the process frame 140, and the annular protruding portion 135 of the flange portion 132 of the photosensitive drum 130 is pivotally supported by the annular protruding portion 162 of the fixing member 160 supported by the bearing part 144 of the process frame 140 (a region is included in which the one end of the drum shaft, the first annular protruding portion of the photosensitive drum, and the second annular protruding portion of the fixing member overlap with each other). Therefore, influence is reduced of bending of the drum shaft 150 and deviation to one side of the fitting gap, and runout of the photosensitive drum 130 is inhibited.

In particular, the bearing part 144 of the process frame 140 is arranged to face the overlap region and the region is positioned at the inside of the bearing part 144 of the process frame 140 for supporting the fixing member 160, so that the influence is further reduced of bending of the drum shaft 150 and deviation to one side of the fitting gap.

Next, Modifications 1 to 3 according to the embodiment of the present invention are described in order.

Modification 1

Figure 4:
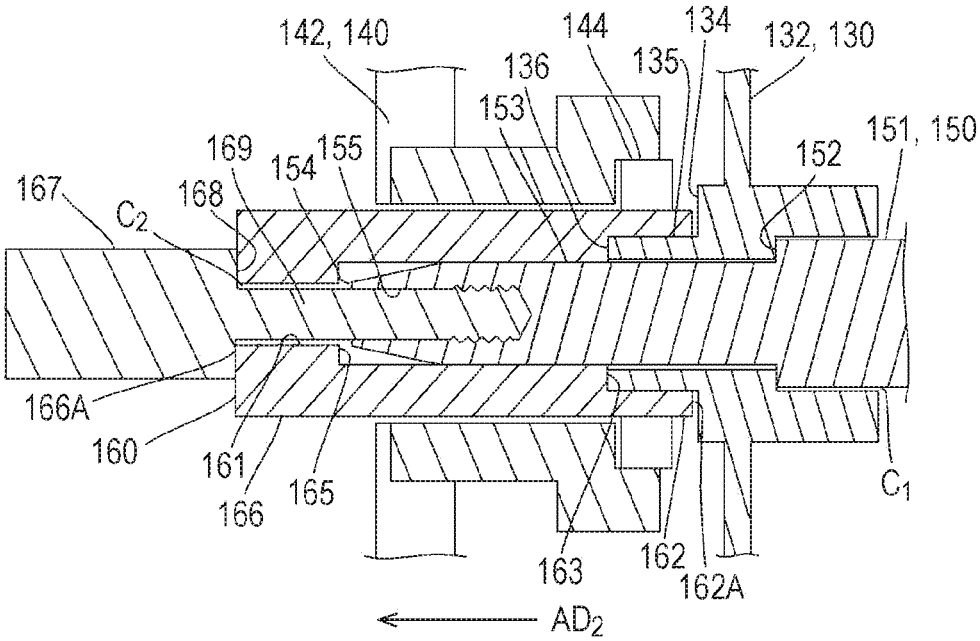
FIG. 4 is a sectional view for explaining Modification 1 according to the embodiment of the present invention.

FIG. 4 is a sectional view for explaining Modification 1 according to the embodiment of the present invention.

The fixing structure of the photosensitive drum is not limited to the form illustrated in FIG. 3. For example, as illustrated in FIG. 4, the fixing structure can be configured so that the end surface 136 (end portion) of the annular protruding portion 135 of the photosensitive drum 130 in the axial direction $AD_2$ of the drum shaft 150, is in contact with the step portion 163 of the fixing member 160 at a position of the axial direction $AD_2$ side of the drum shaft 150 from the end portion of the bearing part 144 in the axial direction $AD_2$, and, in the axial direction $AD_2$, a length of the bearing part 144 is within a length of the annular protruding portion 135.

In this case, a contact portion (base point of deviation of fitting gap) between the annular protruding portion 135 of the photosensitive drum 130 and the fixing member 160 is outside the bearing part 144 of the process frame 140 (distal side from the photosensitive drum 130), so that the influence is further reduced of bending of the drum shaft 150 and deviation to one side of the fitting gap. Incidentally, in this aspect, the step portion 134 of the flange portion 132 of the photosensitive drum 130 is configured not to be in contact with the end surface 162A of the annular protruding portion 162 of the fixing member 160.

Modification 2

Figure 5:
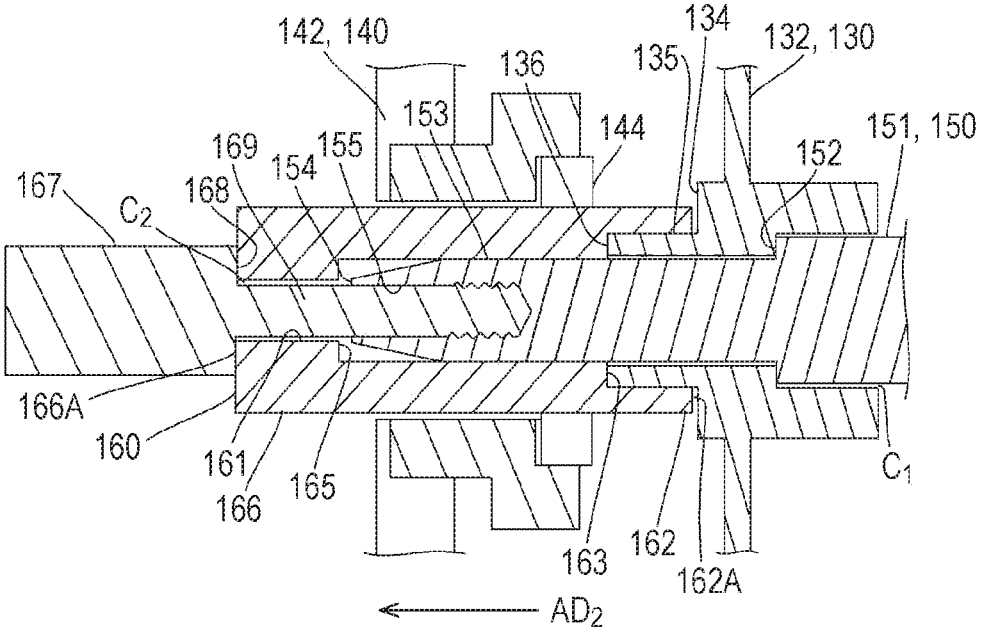
FIG. 5 is a sectional view for explaining Modification 2 according to the embodiment of the present invention.

FIG. 5 is a sectional view for explaining Modification 2 according to the embodiment of the present invention As illustrated in FIG. 5, it is also possible to arrange the bearing part 144 of the process frame 140 at a position spaced apart in the axial direction $AD_2$ of the drum shaft 150 from the region in which the one end 151 of the drum shaft 150, the annular protruding portion 135 of the flange portion 132 of the photosensitive drum 130, and the annular protruding portion 162 of the fixing member 160 overlap with each other.

Modification 3

Figure 6:
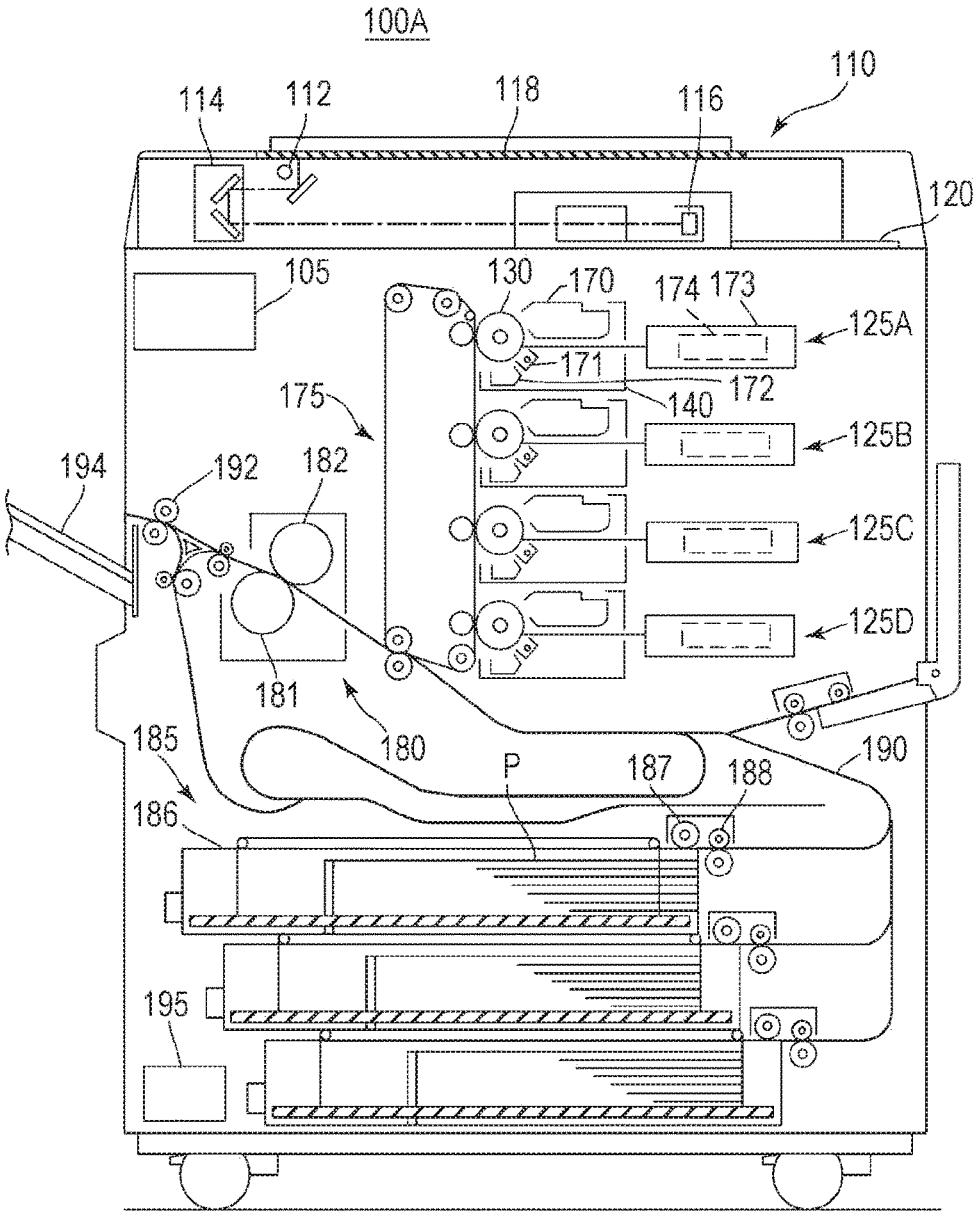
FIG. 6 is a sectional view for explaining Modification 3 according to the embodiment of the present invention.

FIG. 6 is a sectional view for explaining Modification 3 according to the embodiment of the present invention.

The image forming apparatus 100 is not limited to the form of the monochrome copier, and can be, for example, a multi-function peripheral (MFP) including a copy function, a printer function, and a scan function, illustrated in FIG. 6.

In this case, an image forming apparatus 100A includes, for example, an image forming unit 125A for forming a yellow (Y) color image, an image forming unit 125B for forming a magenta (M) color image, an image forming unit 125C for forming a cyan (C) color image, and an image forming unit 125D for forming a black (K) color image, and each of the image forming units includes the process frame 140 and the optical writing unit 173.

Next, performance regarding to drum swing and drum holding force is described.

Figures 7, 8:
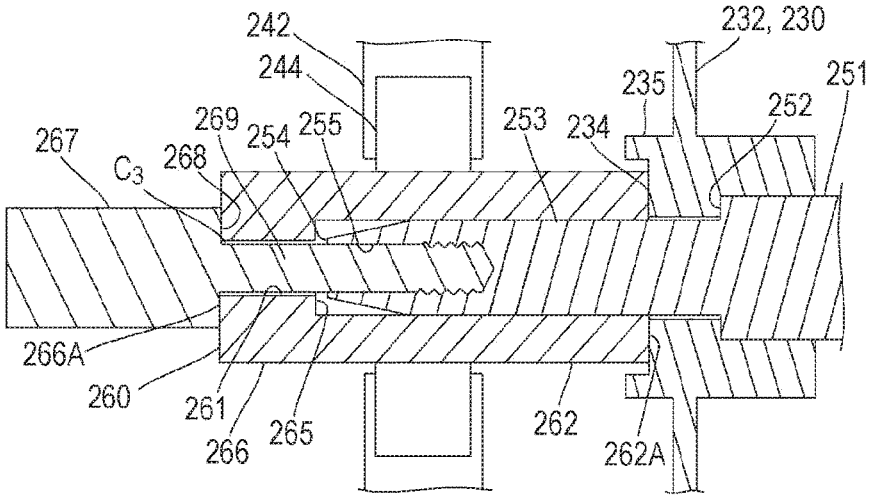
FIG. 7 is a table for explaining performance evaluation results regarding to drum swing and drum holding force of Example 1, Example 2, and Comparative Examples 1 to 3.
FIG. 8 is a sectional view for explaining Comparative Example 1 shown in FIG. 7.
Figure 9:
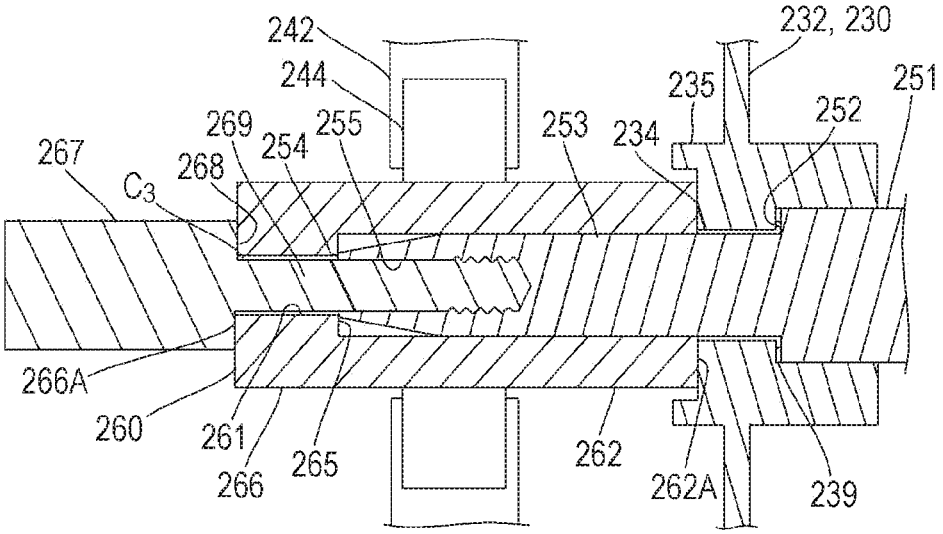
FIG. 9 is a sectional view for explaining Comparative Example 2 shown in FIG. 7.
Figure 10:
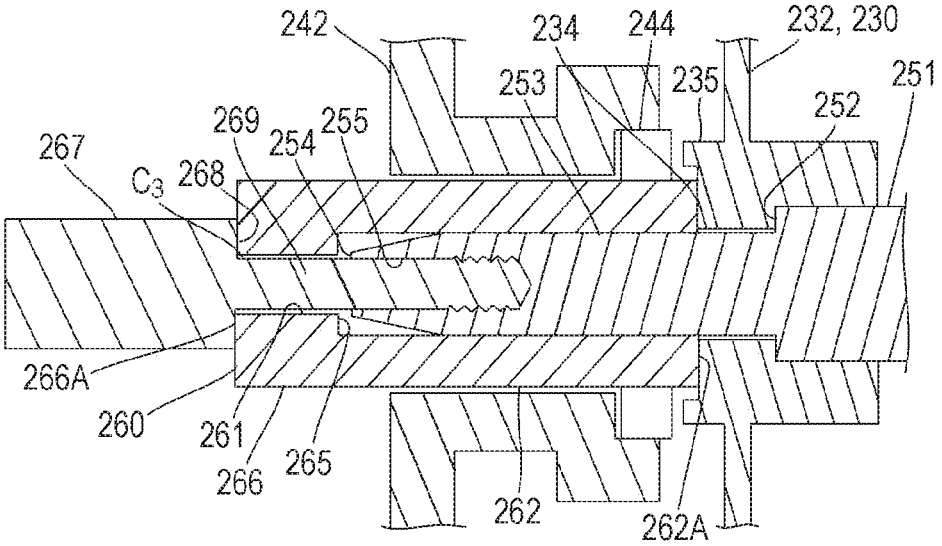
FIG. 10 is a sectional view for explaining Comparative Example 3 shown in FIG. 7.

FIG. 7 is a table for explaining performance evaluation results regarding to the drum swing and the drum holding force of Example 1, Example 2, and Comparative Examples 1 to 3, and FIGS. 8 to 10 are sectional views for explaining Comparative Examples 1 to 3 shown in FIG. 7. Incidentally, codes A, B, and F indicate excellent, acceptable, and practically unacceptable levels, respectively.

Example 1 corresponds to the form illustrated in FIG. 3; the one end 151 of the drum shaft 150 is pivotally supported by the fixing member 160 supported by the bearing part 144 of the process frame 140, the annular protruding portion 135 of the flange portion 132 of the photosensitive drum 130 is pivotally supported by the annular protruding portion 162 of the fixing member 160 supported by the bearing part 144 of the process frame 140, and the bearing part 144 of the process frame 140 is arranged to face the region in which the one end 151 of the drum shaft 150, the annular protruding portion 135 of the flange portion 132 of the photosensitive drum 130, and the annular protruding portion 162 of the fixing member 160 overlap with each other. Example 2 corresponds to the form illustrated in FIG. 4, and, in comparison with Example 1, is further configured so that the end surface 136 (end portion) of the annular protruding portion 135 of the photosensitive drum 130 is in contact with the step portion 163 of the fixing member 160 at a position of the axial direction $AD_2$ side from the end portion of the bearing part 144, in the axial direction $AD_2$ of the drum shaft 150.

Comparative Examples 1 to 3 correspond to the forms illustrated in FIGS. 8 to 10, respectively. Incidentally, in Comparative Examples 1 to 3, similar reference numerals are used for members including similar functions as those of the present embodiments, and descriptions thereof are omitted to avoid redundancy.

Specifically, in Comparative Example 1, an end surface 262A of an annular protruding portion 262 of a fixing member 260 is in contact with a step portion 234 of an annular protruding portion 235 in a flange portion 232 of a photosensitive drum, to stop movement of the photosensitive drum, and an end surface 254 of a reduced diameter portion 253 in one end 251 of a drum shaft is not in contact with a step portion 265 of a fixing member 260.

A step portion 268 of a fastening member 267 is in contact with an end surface 266A of a base portion 266 of the fixing member 260. A protruding portion 269 of the fastening member 267 is inserted to a recess portion 255 of the reduced diameter portion 253 in the one end 251 of the drum shaft, through a through-hole 261 of the fixing member 260, and a screw thread of the protruding portion 269 and a screw thread of the recess portion 255 are screwed together. Thus, the fastening member 267 fastens the photosensitive drum and the drum shaft together through the fixing member 260. Incidentally, a predetermined clearance $C_3$ is set between the outer circumference of the protruding portion 269 of the fastening member 267 and the through-hole 261 of the base portion 266 of the fixing member 260.

A bearing part 244 of a frame 242 of a process frame is arranged to face (surround) the outer circumference of the annular protruding portion 262 of the fixing member 260 at a position spaced apart from the annular protruding portion 235 of the flange portion 232 of the photosensitive drum.

Comparative Example 2 illustrated in FIG. 9 is generally different from. Comparative Example 1 in that the end surface 254 of the reduced diameter portion 253 in the one end 251 of the drum shaft is in contact with the step portion 265 of the fixing member 260. Incidentally, a spring member 239 is configured from, for example, a bending washer, or a web washer, and is positioned between the inner side surface of the flange portion 232 of a photosensitive drum 230 and a step portion 252 of the drum shaft to apply holding force to the drum shaft by being squashed a predetermined amount.

Comparative Example 3 illustrated in FIG. 10 is generally different from Comparative Example 1 in that the bearing part 244 of the frame 242 of the process frame is arranged in the vicinity of the photosensitive drum 230.

Next, performance regarding to drum swing and drum holding force of each of Example 1 and Example 2 is described.

As illustrated in FIG. 7, Example 1, in which the average and maximum of drum swing are respectively 38.1 μm and 60 μm and influence of fitting gap and bending is inhibited, is evaluated as A. In addition, since drum clamping force is large and robustness is high to thick sheet shock noise and tip shift, drum clamping force is evaluated as A.

Example 2, in which the average and maximum of drum swing are respectively 32.4 μm and 49 μm and influence of fitting gap and bending is further inhibited in comparison with Example 1, is evaluated as A. In addition, since drum clamping force is large and robustness is high to thick sheet shock noise and tip shift, drum clamping force is evaluated as A.

Next, performance regarding to drum swing and drum holding force of each of Comparative Examples 1 to 3 is described.

As illustrated in FIG. 7, Comparative Example 1, in which the average and maximum of drum swing are respectively 65.7 μm and 104 μm and runout due to fitting gap is not inhibited, is evaluated as F. It is estimated that bending is increased by fastening force of the fastening member, and as a result, runout is increased. In addition, since clamping force is large and robustness is high to thick sheet shock noise and tip shift, drum clamping force is evaluated as A.

Comparative Example 2, in which the average and maximum of drum swing are respectively 38.9 μm and 68 μm and are improved in comparison with those of Comparative Example 1 but runout due to fitting gap is not sufficiently inhibited, is evaluated as B. In addition, since clamping force is relatively small and robustness is low to thick sheet shock noise and tip shift, drum clamping force is evaluated as B.

Comparative Example 3, in which the average and maximum of drum swing are respectively 36.7 μm and 65 μm and are slightly improved in comparison with those of Comparative Example 2 but runout due to fitting gap is not sufficiently inhibited, is evaluated as B. In addition, since clamping force is large and robustness is high to thick sheet shock noise and tip shift, drum clamping force is evaluated as A.

That is, regarding to drum swing and drum holding force, each of Example 1 and Example 2 obtains an excellent result, without being evaluated as B or F, different from Comparative Examples 1 to 3.

As described above, in the present embodiments, the photosensitive drum is detachable from the process frame that is removable from the apparatus body, so that attaching/detaching of the photosensitive drum is easy. In addition, the one end of the drum shaft is pivotally supported by the fixing member supported by the bearing part, and the first annular protruding portion of the photosensitive drum is pivotally supported by the second annular protruding portion supported by the fixing member of the bearing part (a region is included in which the one end of the drum shaft, the first annular protruding portion of the photosensitive drum, and the second annular protruding portion of the fixing member overlap with each other), so that influence is reduced of bending of the drum shaft and deviation to one side of the fitting gap, and runout of the photosensitive drum is inhibited. Therefore, the image forming apparatus can be provided capable of inhibiting runout of the photosensitive drum while ensuring detachment easiness of the photosensitive drum.

The present invention is not limited to the embodiments described above, and can be variously modified within the scope of appended claims. For example, the image forming apparatus is not limited to the monochrome copier or the MFP, and can be a machine specifically for printing, or a facsimile machine.

Although the present invention has been described and illustrated in detail, it is clearly understood that the same is by way of illustrated and example only and is not to be taken byway of limitation, the scope of the present invention being interpreted by terms of the appended claims.

What is claimed is:

1. An image forming apparatus comprising:

a photosensitive drum;

a process frame from which the photosensitive drum is detachable;

an apparatus body from which the process frame is removable;

a drum shaft including one end constituting a free end, and another end supported by the apparatus body, and transmitting rotational driving force to the photosensitive drum; and a fixing member configured to stop movement of the photosensitive drum in an axial direction of the drum shaft, wherein the one end of the drum shaft is configured to penetrate through and protrude from the photosensitive drum, the photosensitive drum includes a first annular protruding portion configured to surround an outer circumference of the one end of the drum shaft, the process frame includes a bearing part configured to directly support the fixing member, the fixing member includes a second annular protruding portion configured to surround an outer circumference of the first annular protruding portion of the photosensitive drum, the drum shaft, the first annular protruding portion, and the second annular protruding portion are arranged so that only the first annular protruding portion is disposed between the drum shaft and the second annular protruding portion in a radial direction, the one end of the drum shaft is pivotally supported by the fixing member supported by the bearing part, the first annular protruding portion of the photosensitive drum is pivotally supported by the second annular protruding portion of the fixing member supported by the bearing part.

2. The image forming apparatus according to claim 1, wherein the bearing part is arranged to face a region in which the one end of the drum shaft, the first annular protruding portion of the photosensitive drum, and the second annular protruding portion of the fixing member overlap with each other.

3. The image forming apparatus according to claim 1, wherein an end portion of the first annular protruding portion of the photosensitive drum in a removal direction in which the photosensitive drum is removed from the drum shaft, is in contact with the fixing member at a position of the removal direction side from an end portion of the bearing part in the removal direction.

4. The image forming apparatus according to claim 1, wherein the apparatus body includes a bearing part configured to support the other end of the drum shaft.

5. The image forming apparatus according to claim 1, further comprising a fastening member configured to fasten the photosensitive drum and the drum shaft together through the fixing member.

6. The image forming apparatus according to claim 5, wherein the fixing member includes a through-hole communicating with the second annular protruding portion, the one end of the drum shaft includes a recess portion in which a screw thread is formed, the fastening member includes a protruding portion penetrating the through-hole of the fixing member and being inserted to the recess portion of the drum shaft, and the protruding portion of the fastening member includes a screw thread to be screwed into the screw thread of the recess portion of the drum shaft.

7. The image forming apparatus according to claim 1, wherein the fixing portion is fixed with respect to the drum shaft.

8. An image forming apparatus comprising:

a photosensitive drum;

a process frame from which the photosensitive drum is detachable;

an apparatus body from which the process frame is removable;

a drum shaft including one end constituting a free end, and another end supported by the apparatus body, and transmitting rotational driving force to the photosensitive drum;

a fixing member configured to stop movement of the photosensitive drum in an axial direction of the drum shaft, and a fastening member configured to fasten the photosensitive drum and the drum shaft together through the fixing member, wherein the one end of the drum shaft is configured to penetrate through and protrude from the photosensitive drum, the photosensitive drum includes a first annular protruding portion configured to surround an outer circumference of the one end of the drum shaft, the process frame includes a bearing part configured to support the fixing member, the fixing member includes a second annular protruding portion configured to surround an outer circumference of the first annular protruding portion of the photosensitive drum, the one end of the drum shaft is pivotally supported by the fixing member supported by the bearing part, the first annular protruding portion of the photosensitive drum is pivotally supported by the second annular protruding portion of the fixing member supported by the bearing part, and the fixing member includes a through-hole communicating with the second annular protruding portion, the one end of the drum shaft includes a recess portion in which a screw thread is formed, the fastening member includes a protruding portion penetrating the through-hole of the fixing member and being inserted to the recess portion of the drum shaft, and the protruding portion of the fastening member includes a screw thread to be screwed into the screw thread of the recess portion of the drum shaft.

* * * * *